US010115540B2

(12) United States Patent
Kim et al.

(10) Patent No.: US 10,115,540 B2
(45) Date of Patent: Oct. 30, 2018

(54) ELECTRONIC DEVICE

(71) Applicant: Samsung Electronics Co., Ltd., Gyeonggi-do (KR)

(72) Inventors: Kyung-Pil Kim, Gyeonggi-do (KR); Myung-Hyo Bae, Daegu (KR); Sang-Hun Park, Busan (KR); Jong-Hyun Lee, Gyeonggi-do (KR); Ju-Ho Yi, Gyeonggi-do (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 114 days.

(21) Appl. No.: 15/048,603

(22) Filed: Feb. 19, 2016

(65) Prior Publication Data

US 2016/0284490 A1 Sep. 29, 2016

(30) Foreign Application Priority Data

Mar. 24, 2015 (KR) ..... 10-2015-0040645

(51) Int. Cl.
*H01H 13/14* (2006.01)
*H01H 13/10* (2006.01)

(52) U.S. Cl.
CPC ..... *H01H 13/14* (2013.01); *H01H 13/10* (2013.01); *H01H 2221/03* (2013.01); *H01H 2221/05* (2013.01); *H01H 2221/056* (2013.01); *H01H 2229/022* (2013.01); *H01H 2231/022* (2013.01)

(58) Field of Classification Search
CPC ..... H01H 13/14; H01H 2231/022; H01H 2229/022
USPC ..... 200/520
See application file for complete search history.

(56) References Cited

U.S. PATENT DOCUMENTS 8,284,568 B2 * 10/2012 Xiao ..... H01H 13/705 361/748
8,542,482 B2 * 9/2013 Hsiung ..... H01H 13/705 200/341
8,981,245 B2 * 3/2015 Dinh ..... H01H 1/20 200/243
9,691,570 B1 * 6/2017 Dinh ..... H01H 13/10
2001/0013463 A1 * 8/2001 Asai ..... H01H 13/14 200/1 B
2007/0108033 A1 * 5/2007 Lin ..... H01H 13/52 200/520
2012/0050962 A1 * 3/2012 Hsiung ..... H01H 13/705 361/679.01
2012/0241295 A1 * 9/2012 Huang ..... H01H 3/50 200/330

(Continued)

FOREIGN PATENT DOCUMENTS

JP 2000-311544 A 11/2000
KR 10-2014-0026106 A 3/2014

*Primary Examiner* — Kyung Lee

(57) ABSTRACT

An electronic device includes a support member, an ornamental member that is assembled to face one face of the support member, and an operating member that is disposed on the support member to be partially exposed to the outside through the ornamental member. The operating member includes a body that is positioned on one face of the support member to be exposed through the ornamental member, and at least one pair of fastening pieces, each of which extends from the body to be fastened to the support member. Other embodiments are also disclosed.

17 Claims, 11 Drawing Sheets

(56) References Cited

U.S. PATENT DOCUMENTS

| | | | | |
|---|---|---|---|---|
| 2012/0325637 | A1* | 12/2012 | Kikuchi | H01H 13/063<br>200/520 |
| 2013/0020187 | A1* | 1/2013 | Chen | H01H 23/143<br>200/520 |
| 2014/0048400 | A1* | 2/2014 | Malek | H01H 13/06<br>200/517 |
| 2015/0008114 | A1* | 1/2015 | Jung | H01H 13/83<br>200/517 |

* cited by examiner

ELECTRONIC DEVICE

CROSS-REFERENCE TO RELATED APPLICATION AND CLAIM OF PRIORITY

The present application is related to and claims benefit under 35 U.S.C. § 119(a) to Korean Application Serial No. 10-2015-0040645, which was filed in the Korean Intellectual Property Office on Mar. 24, 2015, the entire content of which is hereby incorporated by reference.

TECHNICAL FIELD

Various embodiments of the present disclosure relate to an electronic device. For example, various embodiments of the present disclosure relate to an electronic device that includes an operation member (e.g., a key) that is exposed through an ornamental member (e.g., a window member), which is disposed on the exterior of the electronic device.

BACKGROUND

An electronic device refers to a device that performs a specific function according to an equipped program, such as an electronic scheduler, a portable multimedia reproducer, a mobile communication terminal, a tablet PC, an image/sound device, a desktop/laptop PC, or a vehicular navigation system, as well as a home appliance. For example, such electronic devices may output, as sound or an image, information stored therein or information provided from a communication service provider. As the integration degree of such electronic devices have increased, and super-high speed and large capacity wireless communication has become popular, various functions have recently been equipped in a single electronic device, such as a mobile communication terminal. For example, functions (e.g., an entertainment function (e.g., a game function), a multimedia function (e.g., a music/video reproducing function), a communication and security function for mobile banking, a schedule management function, and an e-wallet function) are integrated into a single electronic device, in addition to a communication function.

Such electronic devices may recognize a user input through various input devices. For example, a power key or side keys can generate an input signal by being mechanically operated by the user, and when a display device is equipped with a touch panel, an input signal can be generated merely by the user's touch. In the structure that generates the input signal merely by the user's touch, for example, recognition accuracy may be adjusted by, for example, setting the software of the touch panel. On the contrary, in the case of the keys, which generate an input signal by being mechanically operated, the accuracy of a key operation may vary depending on, for example, a manufacturing tolerance or an assembly tolerance, and an operating feeling (e.g., a click feeling) to be experienced by the user may also vary. Accordingly, in manufacturing the keys that generate an input signal by being mechanically operated, for example, the manufacturing tolerance or the assembly tolerance may be strictly managed in order to ensure the quality of a predetermined level.

SUMMARY

However, in the case where the quality of the mechanically operated keys does not reach a permitted level (e.g., in the case where the keys are discriminated as defective ones by being deviated from the manufacturing tolerance or exceeding the assembly tolerance), it may be difficult to correct the keys due to a structure of an electronic device.

For example, in a structure where a mechanically operated key is disposed between two components, which are bonded to each other, there may occur a hassle since the two bonded components should be separated again when, for example, the operating state of the key is discriminated as being defective after the key is assembled. Each of the two bonded components may be damaged in the process of being separated again, which may aggravate the fatigue of a worker.

To address the above-discussed deficiencies, it is a primary object to provide an electronic device, of which a defect can be easily determined in the assembly process thereof so as to facilitate the replacement of defective components or to correct an assembly tolerance.

In addition, various embodiments of the present disclosure provide an electronic device that can be easily corrected during the assembly process thereof so as to improve an assembly quality.

In addition, various embodiments of the present disclosure provide an electronic device, which can improve the convenience in assembly operation for a worker, and can provide an improved operating feeling to a user.

Thus, according to various embodiments of the present disclosure, an electronic device may include a support member, an ornamental member that is assembled to face one face of the support member, and an operating member that is disposed on the support member and is partially exposed to the outside through the ornamental member. The operating member includes a body positioned on one face of the support member to be exposed through the ornamental member, and at least one pair of fastening pieces, each of which extends from the body and is fastened to the support member.

The above-described electronic device may further include a circuit board that is disposed on the support member, and the circuit board may include a switch member that is operated by the operating member.

The above-described electronic device may further include a display element that is interposed between the support member and the ornamental member, and the ornamental member may include a window member that transmits a screen that is output from the display element.

The above-described electronic device enables the positioning and assembly of the operating member (e.g., a key that is operated by a user) merely by fastening the fastening pieces to the support member, and enables the determination of poor manufacturing of the operating member or the support member even in a state where the operating member is assembled to the support member. Accordingly, a defective component may be replaced or an assembled state may be corrected as needed, prior to assembling the ornamental member to the support member, so that the assembly quality of the electronic device can be improved. In addition, since the assembly quality can be maintained at a predetermined level even after the ornamental member is assembled to the support member, the worker's fatigue can be alleviated and a uniform and improved operating feeling can be provided to the user.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
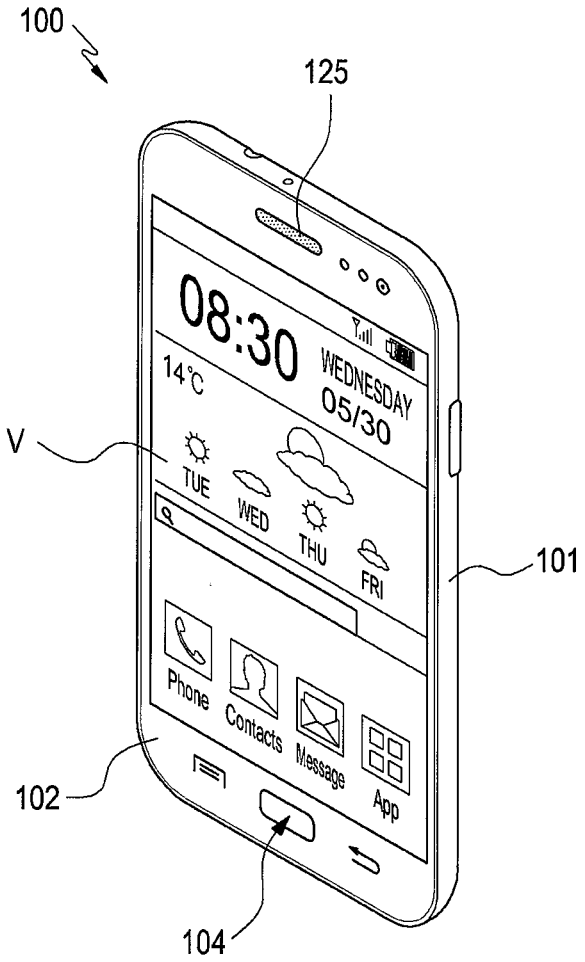
FIG. 1 is a perspective view illustrating an electronic device according to various embodiments of the present disclosure.

FIGS. 1 through 16, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged electronic devices. Hereinafter, various embodiments of the present disclosure will be described with reference to the accompanying drawings. However, it should be understood that there is no intent to limit the present disclosure to the particular forms disclosed herein; rather, the present disclosure should be construed to cover various modifications, equivalents, and/or alternatives of embodiments of the present disclosure. In describing the drawings, similar reference numerals may be used to designate similar constituent elements.

In the present disclosure, the expression "A or B", "at least one of A or/and B", or "one or more of A or/and B" may include all possible combinations of the items listed. For example, the expression "A or B", "at least one of A and B", or "at least one of A or B" refers to all of (1) including at least one A, (2) including at least one B, or (3) including all of at least one A and at least one B.

The expression "a first", "a second", "the first", or "the second" used in various embodiments of the present disclosure may modify various components regardless of the order and/or the importance but does not limit the corresponding components. For example, a first user device and a second user device indicate different user devices although both of them are user devices. For example, a first element may be termed a second element, and similarly, a second element may be termed a first element without departing from the scope of the present disclosure.

It should be understood that when an element (e.g., first element) is referred to as being (operatively or communicatively) "connected," or "coupled," to another element (e.g., second element), it may be directly connected or coupled directly to the other element or any other element (e.g., third element) may be interposer between them. In contrast, it may be understood that when an element (e.g., first element) is referred to as being "directly connected," or "directly coupled" to another element (second element), there are no element (e.g., third element) interposed between them.

The expression "configured to" used in the present disclosure may be exchanged with, for example, "suitable for", "having the capacity to", "designed to", "adapted to", "made to", or "capable of" according to the situation. The term "configured to" may not necessarily imply "specifically designed to" in hardware. Alternatively, in some situations, the expression "device configured to" may mean that the device, together with other devices or components, "is able to". For example, the phrase "processor adapted (or configured) to perform A, B, and C" may mean a dedicated processor (e.g. embedded processor) only for performing the corresponding operations or a generic-purpose processor (e.g., central processing unit (CPU) or application processor (AP)) that can perform the corresponding operations by executing one or more software programs stored in a memory device.

In the present disclosure, the terms are used to describe specific embodiments, and are not intended to limit the present disclosure. As used herein, the singular forms are intended to include the plural forms as well, unless the context clearly indicates otherwise. In the description, it should be understood that the terms "include" or "have" indicate existence of a feature, a number, a step, an operation, a structural element, parts, or a combination thereof, and do not previously exclude the existences or probability of addition of one or more another features, numeral, steps, operations, structural elements, parts, or combinations thereof.

Unless defined differently, all terms used herein, which include technical terminologies or scientific terminologies, have the same meaning as that understood by a person skilled in the art to which the present disclosure belongs. Such terms as those defined in a generally used dictionary are to be interpreted to have the meanings equal to the contextual meanings in the relevant field of art, and are not to be interpreted to have ideal or excessively formal meanings unless clearly defined in the present specification. In some cases, even the term defined in the present disclosure should not be interpreted to exclude embodiments of the present disclosure.

In the present disclosure, an electronic device may be a random device, and the electronic device may be called a terminal, a portable terminal, a mobile terminal, a communication terminal, a portable communication terminal, a portable mobile terminal, a display device or the like.

For example, the electronic device may be a smartphone, a portable phone, a game player, a TV, a display unit, a heads-up display unit for a vehicle, a notebook computer, a laptop computer, a tablet Personal Computer (PC), a Personal Media Player (PMP), a Personal Digital Assistants (PDA), and the like. The electronic device may be implemented as a portable communication terminal which has a wireless communication function and a pocket size. Further, the electronic device may be a flexible device or a flexible display device.

The electronic device may communicate with an external electronic device, such as a server or the like, or perform an operation through an interworking with the external electronic device. For example, the electronic device may transmit an image photographed by a camera and/or position information detected by a sensor unit to the server through a network. The network may be a mobile or cellular communication network, a Local Area Network (LAN), a Wireless Local Area Network (WLAN), a Wide Area Network (WAN), an Internet, a Small Area Network (SAN) or the like, but is not limited thereto.

FIG. 1 is a perspective view illustrating an electronic device 100 according to various embodiments of the present disclosure.

Referring to FIG. 1, according to various embodiments of the present disclosure, an electronic device 100 can include a housing 101, and an ornamental member 102 that is installed on the front face of the housing 101. The ornamental member 102 can include a window member that transmits a screen V that is output from the display element 121 (see FIG. 2). On the front face of the housing 101, for example, an operating member 104 can be disposed at one side of a region, which transmits and displays the screen V, to be exposed to the outside through the ornamental member 102. The operating member 104 can include a mechanically operated key, and other operating members, which generate an input signal by the user's touch, can be disposed at the opposite sides of the operating member 104. At another side (e.g., the upper side) of the region that displays the screen V, an opening can be provided to output sound, and a screen 125 (e.g., a non-woven fabric that is made of a fiber material or a mesh that is made of a metal material) is installed on the opening so as to block the inflow of foreign matter.

For example, a power key, a sound input hole, or various connector holes can be disposed on a side face or an upper/lower end face of the housing 101. Since this can be easily understood by a person ordinarily skilled in the art, the detailed description thereof will be omitted.

Figure 2:
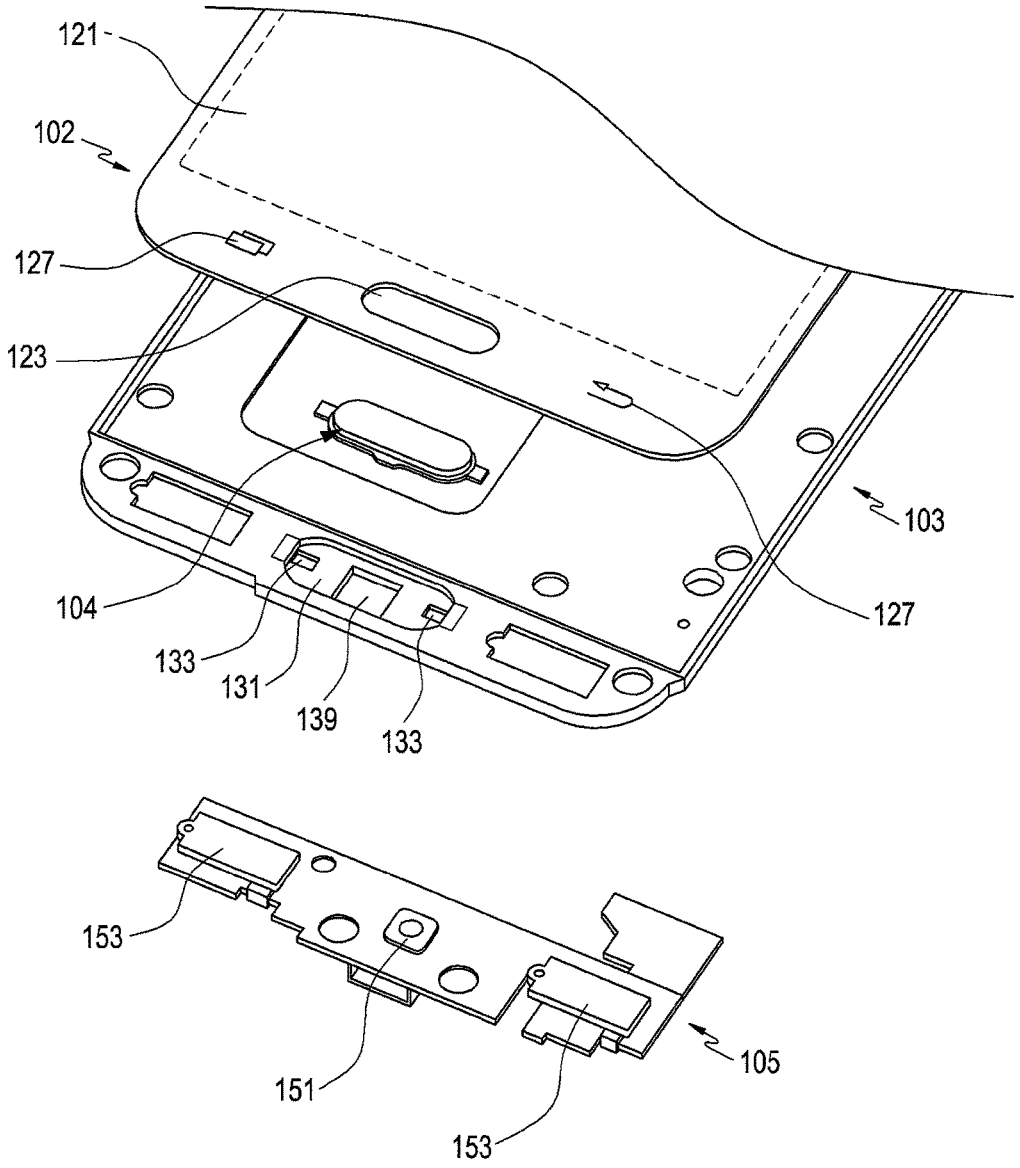
FIG. 2 is a perspective view illustrating an electronic device according to a first one of various embodiments of the present disclosure in a state where the electronic device is partially disassembled.

FIG. 2 is a perspective view illustrating an electronic device 100 according to a first one of various embodiments of the present disclosure in a state where the electronic device is partially disassembled.

Referring to FIG. 2, the electronic device 100 can include a support member 103 and a circuit board 105 that are disposed within the housing 101.

The support member 103 can provide a structure that allows, for example, the circuit board 105 to be mounted and fixed thereto while improving the rigidity of the electronic device 100. In addition, the support member 103 supports and fixes the ornamental member 102 (e.g., the display element 121 that is installed inside the ornamental member 102) in a flat plate shape, so that other structures can be prevented from coming in contact with the display element 121.

The support member 103 can be provided with an accommodation recess 131 so as to install the operating member 104 therein. The accommodation recess 131 can be positioned in one side edge on the support member 103, and the operating member 104 can be disposed in the accommodation recess 131 to be exposed to the outside through the ornamental member 102. For example, a first through-hole 123 can be formed in the ornamental member 102 to correspond to the accommodation recess 131, and the operating member 104 can be exposed to the outside of the electronic device 100 (e.g., the ornamental member 102) through the first through-hole 123. As described above, at the opposite sides of the operating member 104 on the ornamental member 102, keys, which generate an input signal by the user's touch, can be disposed, and patterns 127, which correspond to the keys, respectively, can be printed on the ornamental member 102.

The circuit board 105 can be disposed to face the operating member 104 or the ornamental member 102 with the support member 103 being interposed therebetween. The circuit board 105 can include a switch member 151 that is operated by the operating member 104. The support member 103 can include a second through-hole 139 that is formed on the accommodation recess 131. The switch member 151 can be disposed to face the operating member 104 through the second through-hole 139. The circuit board 105 can further include a touch pad(s) 153 that is formed of a flexible printed circuit board. For example, a portion of the circuit board 105 can be formed of a flexible printed circuit board. The touch pad(s) 153 can be arranged at the opposite sides of the operating member 104 on one face of the support member 103 to correspond to the pattern(s) 127 that is formed on the ornamental member 102. For example, a great portion of the circuit board 105 can be disposed to face the bottom face on the support member 103, and a portion of the circuit board 105 (e.g., the touch pad(s) 153) can be disposed to face the top face on the support member 103. The touch pad(s) 153 can generate an input signal depending on whether the user touches the positions where the patterns 127 are formed. For example, the touch pad(s) 153 can be arranged as the keys that generate an input signal by the user's touch.

Hereinbelow, the operating member 104 and an installation structure thereof will be described in more detail with reference to FIGS. 3 to 8.

Figure 3:
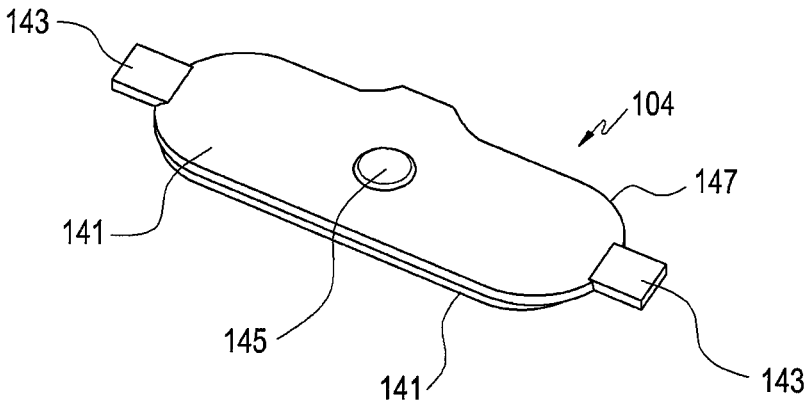
FIG. 3 is a perspective view illustrating an operating member of the electronic device according to the first one of various embodiments of the present disclosure.
Figure 4:
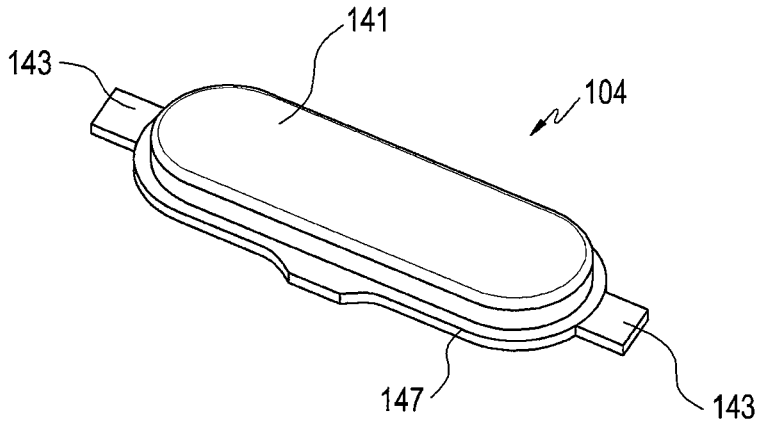
FIG. 4 is a perspective view illustrating the operating member of the electronic device according to the first one of various embodiments of the present disclosure, in which the operating member is viewed from another direction.

FIG. 3 is a perspective view illustrating the operating member 104 of the electronic device 100 according to the first one of various embodiments of the present disclosure. FIG. 4 is a perspective view illustrating the operating member 104 of the electronic device 100 according to the first one of various embodiments of the present disclosure, in which the operating member 104 is viewed from another direction.

Referring to FIGS. 3 and 4, the operating member 104 can include a body 141 and at least one pair of fastening pieces 143.

The body 141 can be disposed on the accommodation recess 131 to be exposed to the outside through the first through-hole 123. For example, the body 141 can correspond to a portion that is directly operated by the user. The body 141 can have a shape that extends in one direction (e.g., in the widthwise direction of the electronic device 100) and a portion thereof (e.g., opposite ends) can have a curved face (or curved line) shape. The fastening pieces 143 can extend from the opposite ends of the body 141, respectively. The fastening pieces 143 can be fastened to the support member 103 so as to determine the position of the operating member 104, and can provide a means for allowing the operating member 104 to be assembled to the support member 103.

According to various embodiments, the operating member 104 can include an actuating protrusion 145 that is formed on the bottom face of the body 141. When the operating member 104 is arranged in the accommodation recess 131, the actuating protrusion 145 can be positioned to correspond to the second through-hole 139. For example, the actuating protrusion 145 can be disposed to face a switch member 151 through the second through-hole 139.

According to various embodiments, the operating member 104 can include a stepped portion 147 that is formed along the periphery of the body 141. For example, the stepped portion 147 can take a form of protruding to the outside from the outer peripheral surface of the body 141, and can be formed continuously along the periphery of the body 141.

Figure 5:
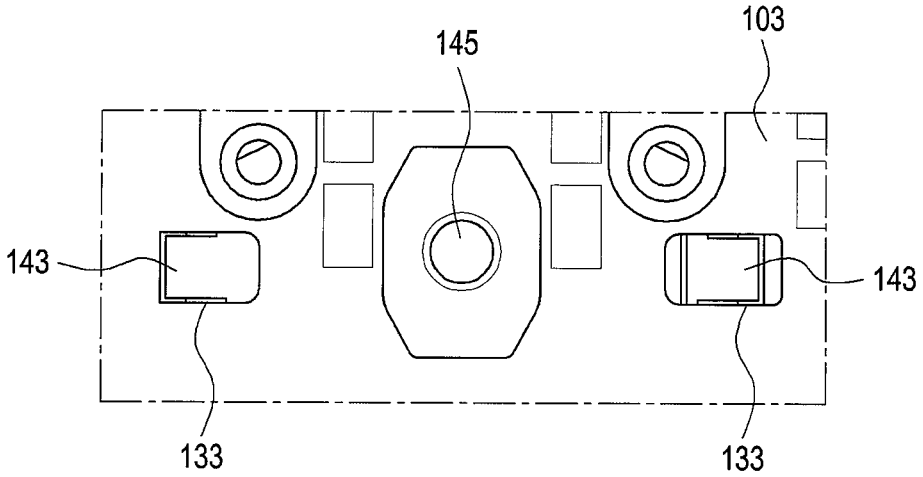
FIG. 5 is a plan view illustrating a state in which the operating member of the electronic device according to the first one of various embodiments of the present disclosure is assembled to a support member.
Figure 6:
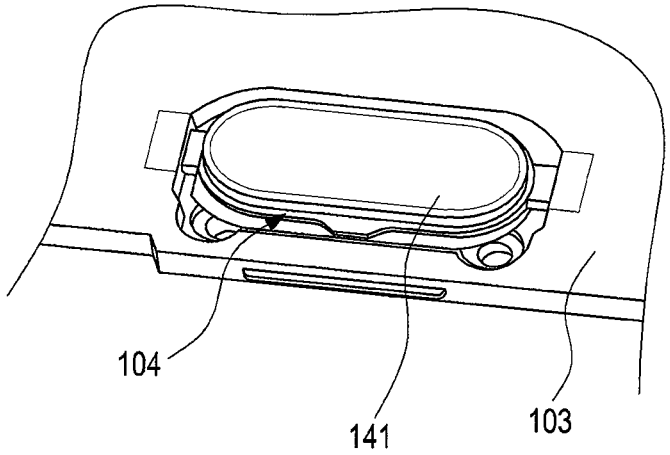
FIG. 6 is a perspective view illustrating a state in which the operating member of the electronic device according to the first one of various embodiments of the present disclosure is assembled to the support member.
Figure 7:
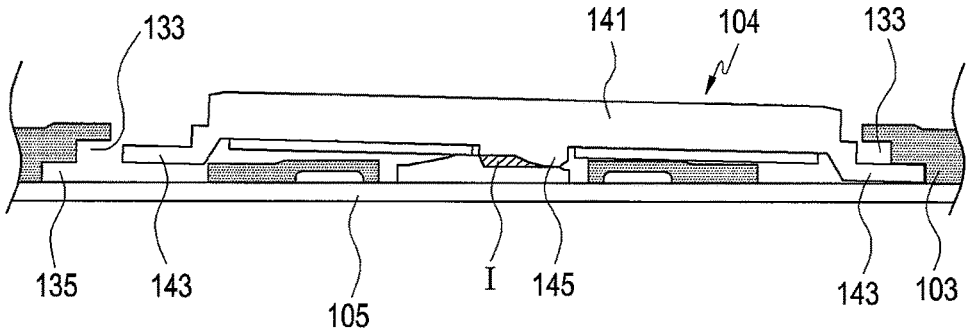
FIG. 7 is a view for describing a process in which the operating member of the electronic device according to the first one of various embodiments of the present disclosure is assembled to the support member.
Figure 8:
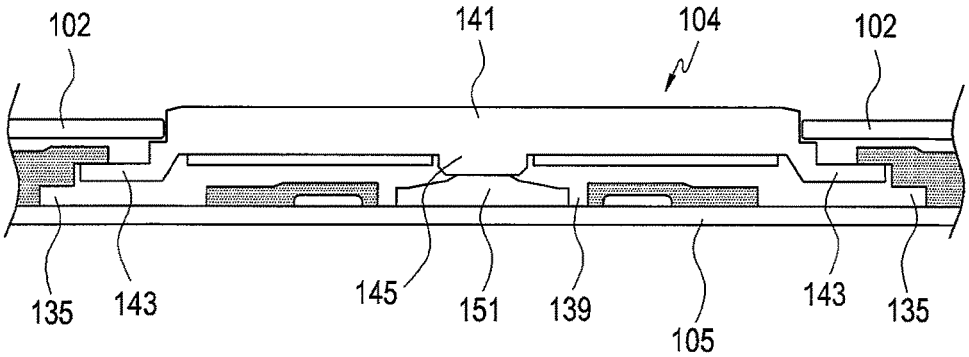
FIG. 8 is a cross-sectional view illustrating a state in which the operating member and an ornamental member of the electronic device according to the first one of various embodiments of the present disclosure are assembled to the support member.

FIG. 5 is a plan view illustrating a state in which the operating member 104 of the electronic device 100 according to the first one of various embodiments of the present disclosure is assembled to the support member 103. FIG. 6 is a perspective view illustrating a state in which the operating member 104 of the electronic device 100 according to the first one of various embodiments of the present disclosure is assembled to the support member 103. FIG. 7 is a view for describing a process in which the operating member 104 of the electronic device 100 according to the first one of various embodiments of the present disclosure is assembled to the support member 103. FIG. 8 is a cross-sectional view illustrating a state in which the operating member 104 and the ornamental member 102 of the electronic device 100 according to the first one of various embodiments of the present disclosure are assembled to the support member 103.

Further referring to FIGS. 5 to 8, when the operating member 104 is assembled onto the support member 103, the fastening pieces 143 can be engaged with the fastening recesses 133, which are formed at the opposite sides of the accommodation recess 131, respectively. That is, the fastening pieces 143 can be fastened to the support member 133 so as to set the position of the operating member 104, and to provide a means for allowing the operating member 104 to be fastened to the support member 103. The fastening recesses 133 can be formed on the opposite side walls of the accommodation recess 131, respectively. Each of the fastening recesses 133 can extend in a direction away from the accommodation recess 131. Retreating recesses 135 can be formed on the support member 103 to be more outside than the fastening recesses 133. The retreating recesses 135 are to provide spaces into which the fastening pieces 143 are temporarily movable in the process of assembling the operating member 104 to the support member 103. For example, the retreating recesses 135 can facilitate the assembly of the operating member 104.

The circuit board 105 can be disposed to face the operating member 104 with the support member 103 being interposed therebetween. For example, the circuit board 105 can be disposed below the support member 103 and the operating member 104 can be disposed above the support member 103. When the circuit board 105 is assembled to the support member 103, the switch member 151 can be positioned within the second through-hole 139.

Referring to FIG. 7, the operating member 104 can be assembled from the state in which the operating member 104 is positioned such that one of the fastening pieces 143 is fully accommodated in the fastening recess 133 and the corresponding retreating recess 135. For example, the assembly of the operating member 104 can be initiated from the state in which the operating member 104 is positioned such that one of the fastening pieces 143 is accommodated in one of the retreating recesses 135 (e.g., the state illustrated in FIG. 7). In the state illustrated in FIG. 7, the worker can push the body 141 of the operating member 104 in the direction of being accommodated in the accommodation recess 131 (e.g., downward in FIG. 7) so that the other fastening piece 143 is positioned to be in line with the corresponding fastening recess 133. During this process, the actuating protrusion 145 can partially interfere with the switch member 151 (as indicated by "I"). In the state where one of the fastening pieces 143 is accommodated in the corresponding retreating recess 135 and the other fastening piece 143 is positioned to be in line with the corresponding fastening recess 133, the operating member 104 can move horizontally so that the other fastening piece 143 is engaged with the corresponding fastening recess 133. For example, the fastening pieces 143 can be engaged with the fastening recesses 133 while the body 141 reciprocates in the direction where the fastening recesses 133 extend in the accommodation recess 131, and during this process, the body 141 can be accommodated in the accommodation recess 131. As the fastening pieces 143 are engaged with the fastening recesses 133, respectively, the operating member 104 can be assembled and fastened to the support member 103.

When the assembly of the operating member 104 is completed, the horizontal movement of the operating member 104 can be restricted by the structures of the fastening pieces 143 and the fastening recesses 133. In addition, as the fastening pieces 143 interfere with the inner walls of the fastening recesses 133 at the top side and the actuating protrusion 145 interferes with the switch member 151 at the bottom side, the vertical movement can be restricted. However, when an external force is applied (e.g., when the user operates the operating member 104), the body 141 moves downward, and the actuating protrusion 145 can actuate the switch member 151.

Determination on the assembly quality of the operating member 104 can be made in the state where the operating member 104 is assembled to the support member 103. For example, in the state where a further assembly process occurs after the operating member 104 is assembled, the assembly quality can be verified by operating the operating member 104. When the operating feeling does not satisfy a prescribed quality due to the manufacturing tolerance or the assembly error of each of the operating member 104 and the support member 103, the worker can replace the assembled operating member 104 with another operating member 104 or can reassemble the operating member 104. Accordingly, the assembly quality of the operating member 104 can be easily corrected.

Referring to FIG. 8, with respect to an assembly in which the operating member 104 has a good assembly quality, the ornamental member 102 can be assembled to face the support member 103. The ornamental member 102 can be assembled to face the support member 103 through an adhesive means such as a double-sided tape. When the ornamental member 102 is assembled to the support member 103, the operating member 104 can be exposed to the outside in the state where, for example, the body 141 is partially accommodated in the first through-hole 123. In the state where the ornamental member 102 is assembled to the support member 103, the stepped portion 147 can be supported on the inner wall of the ornamental member 102. In addition, the outer peripheral surface of the body 141 can be supported on the inner wall of the first through-hole 123. Accordingly, the horizontal movement of the ornamental member 104 with respect to the ornamental member 102 can be restricted, and the vertical movement is enabled according to the user's operation.

As described above, according to various embodiments of the present disclosure, it is possible to determine the assembly quality of the electronic device 100 in the state where the operating member 104 is assembled to the support member 103, so that the replacement or correction according to the manufacturing tolerance or poor assembly can be facilitated in the assembly process. In addition, since the ornamental member 102 at least partially accommodates the body 141 of the operating member 104 to restrict the shaking of the operating member 104 in any direction other than the user's operating direction, a stable installation structure can be provided.

Figure 9:
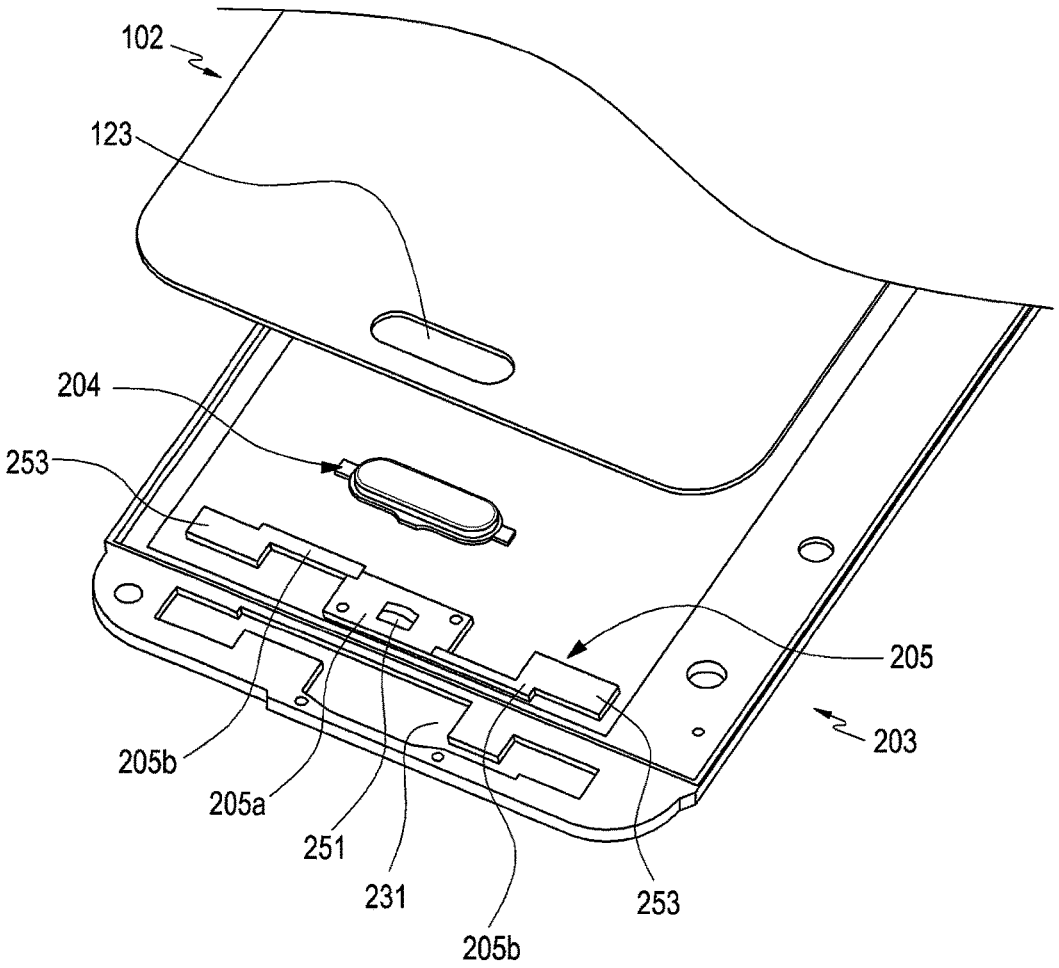
FIG. 9 is a perspective view illustrating an electronic device according to a second one of various embodiments of the present disclosure.
Figure 10:
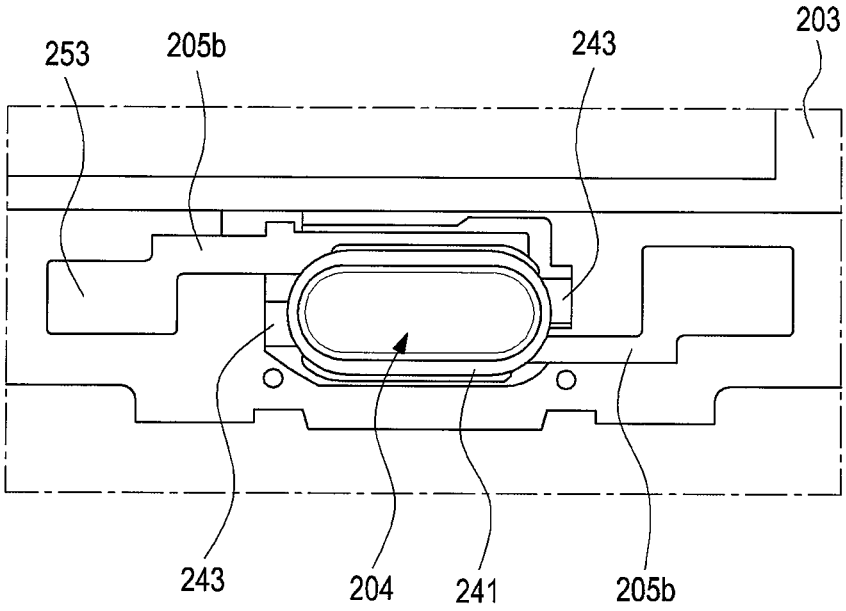
FIG. 10 is a perspective view illustrating a state in which the operating member of the electronic device according to the second one of various embodiments of the present disclosure is assembled to the support member.

FIG. 9 is a perspective view illustrating an electronic device 100 according to a second one of various embodiments of the present disclosure in a state where the electronic device 100 is partially disassembled. FIG. 10 is a plan view illustrating a state in which the operating member 204 of the electronic device 100 according to the second one of various embodiments of the present disclosure is assembled to the support member 203.

The electronic device 100 of the present embodiment is different from that of the preceding embodiment in that in disposing the circuit board 205, the circuit board 205 is disposed on one face of the support member 203 together with the operating member 204. Accordingly, the components, which can be easily understood through the preceding embodiment, can be denoted by the same reference numerals as the preceding embodiment or the reference numerals can be omitted, and the detailed descriptions thereof can also be omitted.

Referring to FIGS. 9 and 10, The circuit board 205 of the electronic device 100 can be disposed on one face of the support member 203 together with the operating member 204, and the circuit board 205 can be disposed to face the ornamental member 102 with the operating member 204 being interposed therebetween. Similarly to the preceding embodiment, the ornamental member 102 can transmit a screen that is output from the display element.

The operating member 204 can be exposed to the outside of the ornamental member 102 through a through-hole 123 that is formed in the ornamental member 102. For example, the operating member 204 can be operated by the user so as to actuate a switch member 251 that is disposed on the circuit board 205. The operating member 204 can include one pair of fastening pieces 243, each of which extends in a direction away from one of the opposite ends of the body 241, respectively. The fastening pieces 243 can be disposed to be offset to each other (e.g., in FIG. 10, in the state where one fastening piece 243 is disposed to be adjacent to the upper end of the body 241), and the other fastening piece 243 can be disposed to be adjacent to the lower end of the body 241.

The circuit board 205 can include a first switch unit 205*a* in which the switch member 251 is disposed, and second switch units 205*b*, each of which extends in a direction away from the one of the opposite sides of the first switch unit 205*a*. The first switch unit 205*a* can be formed of a rigid printed circuit board, and the second switch units 205*b* can be formed of a flexible printed circuit board. The ends of the second switch units 205*b* can be formed as touch pads 253. The second switch units 205*b* can be disposed to be offset to each other (e.g., in FIG. 10, in the state where one second switch unit 205*b* is disposed to be adjacent to the lower end of the first switch unit 205*a*), and the other second switch unit 205*b* can be disposed to be adjacent to the upper end of the first switch unit 205*a*.

An accommodation recess 231 is formed in the support member 203 to accommodate the circuit board 205 and the operating member 204, and the shape of the accommodation recess 231 can correspond to that of the circuit board 205. In the state where the circuit board 205 is seated in the accommodation recess 231, the operating member 204 can be assembled and fastened to the support member 203. In assembling and fastening the operating member 204 to the support member 203, the structure, which allows the fastening pieces 243 to be fastened to the support member 203, can be implemented similarly to that in the preceding element, and thus, the detailed description thereof will be omitted. However, since the fastening pieces 243 are disposed and formed to be offset to each other as described above, the fastening recesses, which are formed in the support member 203, can also be formed at the positions that correspond to the positions where the fastening pieces are formed. In the state where the circuit board 205 and the operating member 204 are assembled to the support member 203, the second switch units 205*b* can be disposed at one side of the fastening pieces 243 to be in line with the fastening pieces 243. For example, the second switch units 205*b* and the fastening pieces 243 can be disposed to be adjacent to each other in a range where they do not overlap with each other.

In the state where the operating member 204 is assembled to the support member 203, the actuating protrusion of the operating member 204 can be disposed to correspond to the switch member 251. Accordingly, it can be determined whether, for example, the actuating state of the operating member 204 is poor, prior to assembling the ornamental member 102. For example, in the state where the circuit board 205 and the operating member 204 are assembled to the support member 203, the actuating state and operating feeling of the operating member 204 can be tested.

When the operating state and operating feeling of the operating member 204 satisfy a prescribed quality, the ornamental member 102 can be assembled to the support member 203. As described above, the ornamental member 102 can be assembled to the support member 203 through a bonding method using, for example, a double-sided tape. When the ornamental member 102 is formed of a window member, a display element can be disposed on the inner face of the ornamental member 102, and the support member 203 can support the display element in a flat plate shape.

Hereinbelow, descriptions will be made on various structures in which the operating member is assembled to the support member in the electronic device 100 according to various embodiments of the present disclosure with reference to FIGS. 11 to 13.

Figure 11:
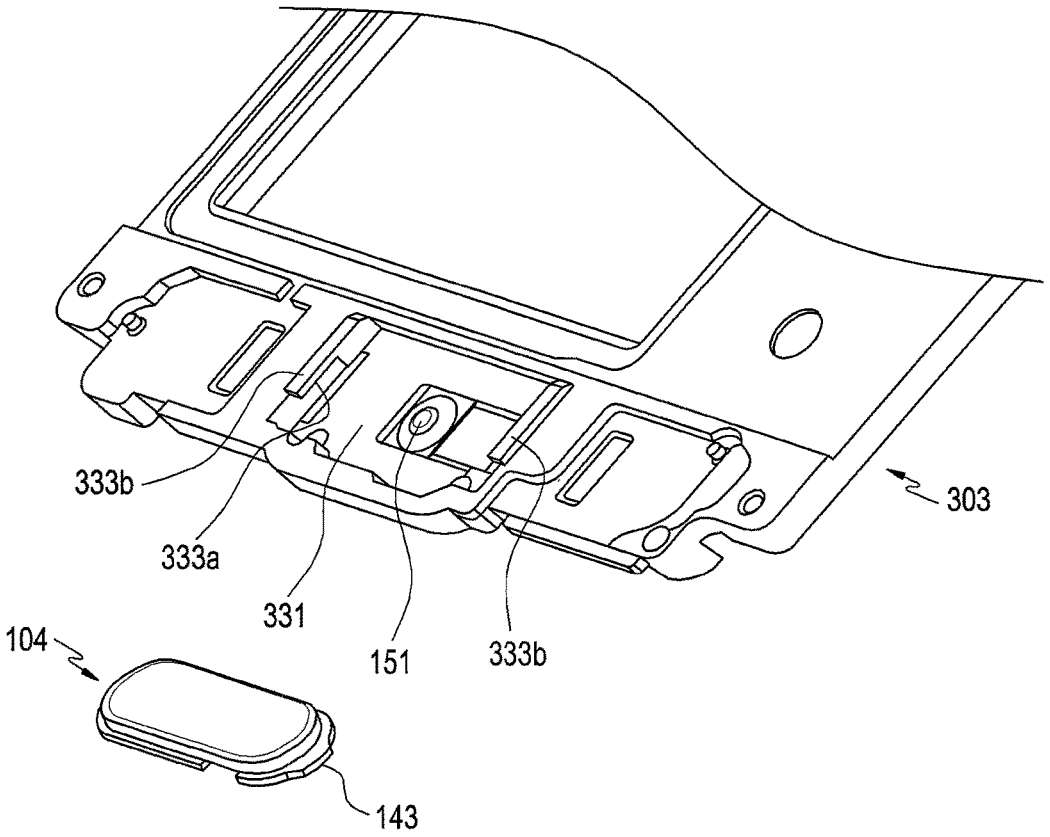
FIG. 11 is a perspective view for describing a process in which the operating member of an electronic device according to a third one of various embodiments of the present disclosure is assembled to the support member.

FIG. 11 is a perspective view for describing a process in which the operating member 104 of the electronic device 100 according to a third one of various embodiments of the present disclosure is assembled to the support member 303.

The support member 303 can include an accommodation recess 331 which is formed on one face thereof, and fastening recesses 333*a* that are formed on opposite side walls of the accommodation recess 331. Fastening ribs 333*b* are formed on the side walls of the accommodation recess 331, and the fastening recesses 333*a* can be formed inside the fastening ribs 333*b*. The fastening recesses 333*a* can extend in a first direction (e.g., in the direction parallel to the bottom face of the accommodation recess 331 at the lower end side of the support member 303).

In the state where the fastening pieces 143 are positioned to correspond to the fastening recesses 333*a*, respectively, the operating member 104 can be gradually accommodated in the accommodation recess 331 by being moved in the direction where the fastening recesses 333*a* extend. At the position where the actuating protrusion of the operating member 104 corresponds to the switch member 151, the operating member 104 can be fully accommodated in the accommodation recess 331. When the operating member 104 is fully accommodated in the accommodation recess 331, the top faces of the fastening pieces 143 interfere with the fastening ribs 333*b*, respectively, and the actuating protrusion of the operating member 104 can interfere with the switch member 151 under the operating member 104. For example, in the state of being fully accommodated in the accommodation recess 331, the operating member 104 can be fixed in the vertical direction with respect to the bottom face of the accommodation recess 331. However, when the user operates the operating member 104, the operating member 104 can move to be close to the bottom face of the accommodation recess 331 to actuate the switch member 151.

In the state where the operating member 104 is assembled to the accommodation recess 331, determination on the assembly quality of the operating member 104 can be made in the state where the above-mentioned ornamental member is not assembled. For example, when there is a manufacturing tolerance in forming the operating member 104 or the accommodation recess 331, the assembly may not be smoothly performed, and the operating feeling of a prescribed quality may not be provided even in the assembled state. In addition, even if each component was manufactured within a tolerance range, the operating feeling of a prescribed quality may not be provided depending on the accuracy of assembly. According to various embodiments of the present disclosure, since the determination of the assembly quality of the electronic device 100 is enabled immediately after the operating member 104 is assembled to the support member 303, the correction can be facilitated even if, for example, poor assembly is caused.

Figure 12:
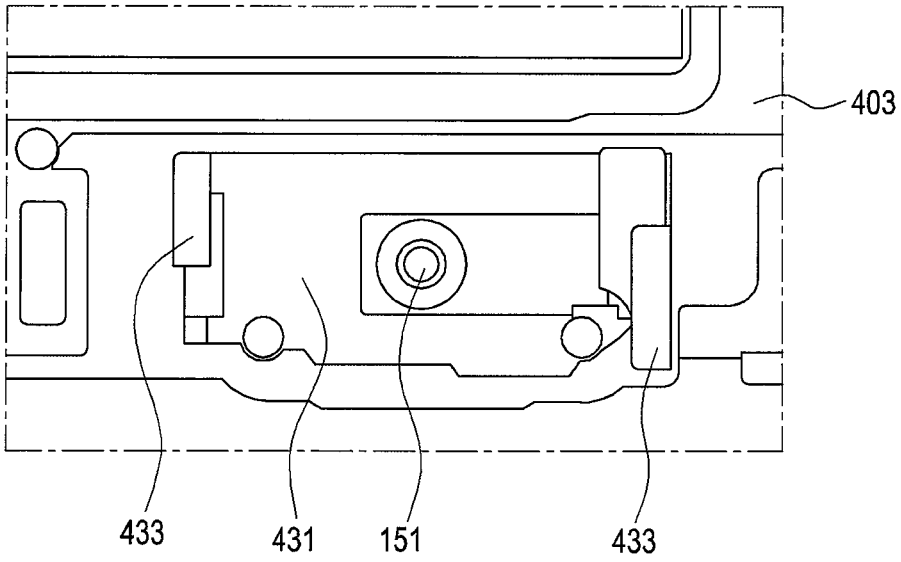
FIG. 12 is a perspective view illustrating a support member of an electronic device according to a fourth one of various embodiments of the present disclosure.

FIG. 12 is a perspective view illustrating a support member 403 of an electronic device 100 according to a fourth one of various embodiments of the present disclosure. FIG. 13 is a view for describing a process in which the operating member 104 of the electronic device 100 according to the fourth one of various embodiments of the present disclosure is assembled to the support member 403.

Figure 13:
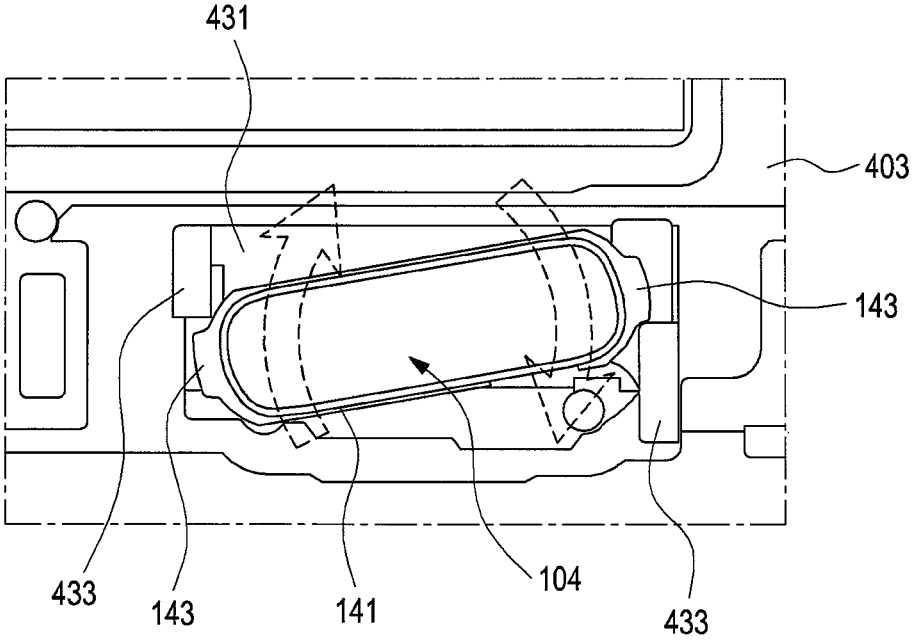
FIG. 13 is a plan view for describing a process in which the operating member of the electronic device according to the fourth one of various embodiments of the present disclosure is assembled to a support member.

Referring to FIGS. 12 and 13, an accommodation recess 431 can be formed in the support member 403 to dispose the switch member 151 therein, and fastening ribs 433 can be formed at the opposite sides of the accommodation recess 431, respectively. Fastening recesses, which correspond to the fastening pieces 143 of the operating member 104, respectively, can be formed inside the fastening ribs 433. The operating member 104 can be exposed to the outside through the through-hole of the ornamental member while being accommodated in the accommodation recess 431. Upon comparing with the embodiment illustrated in FIG. 11, there is a difference in that the fastening ribs 433 are arranged in the opposite directions with respect to each other. For example, while the fastening recesses 333*a* of the embodiment illustrated in FIG. 11 extend in the same direction, the fastening recesses of the present disclosure can extend in the opposite directions with respect to each other.

The operating member 104 can be introduced into the accommodation recess 431 in the state where the operating member 104 is tilted with respect to the widthwise direction or longitudinal direction of the accommodation recess 431. For example, the accommodation recess 431 can be formed to have a sufficient size to accommodate the operating member 104 in the state where the operating member 104 is tilted to a certain degree. When the operating member 104 is accommodated in the accommodation recess 431 in a tilted state, the actuating protrusion of the operating member 104 can be positioned to correspond to the switch member 151. When the operating member 104 is accommodated in the accommodation recess 431, the fastening pieces 143 of the operating member 104 can be positioned to correspond to the fastening recesses that are formed on the side wall of the accommodation recess, respectively. In this state, when the operating member 104 is rotated in one direction (e.g., in the direction where the fastening pieces 143 are engaged with the corresponding fastening recesses, respectively), the operating member 104 can be assembled and fastened to the support member 403.

Figure 14:
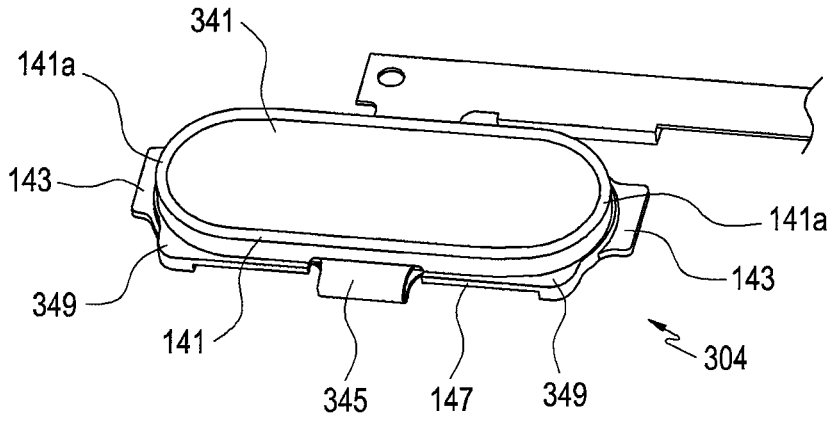
FIG. 14 is a perspective view illustrating an operating member of an electronic device according to a fifth one of various embodiments of the present disclosure.
Figure 15:
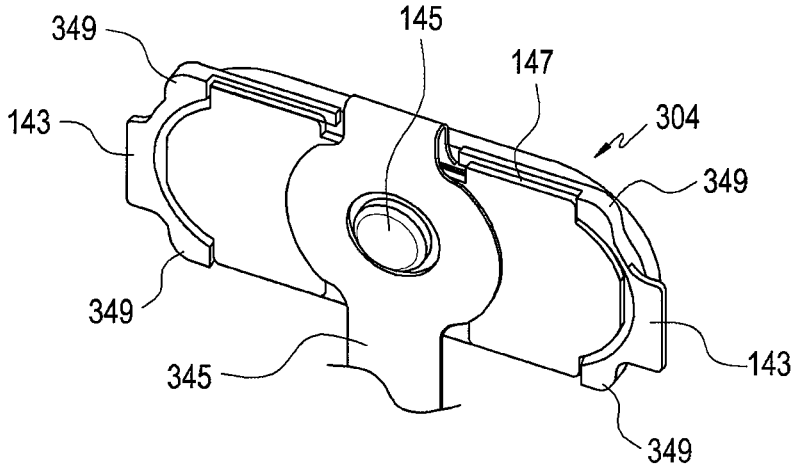
FIG. 15 is a perspective view illustrating the operating member of the electronic device according to the fifth one of various embodiments of the present disclosure, in which the operating member is viewed from another direction.

FIG. 14 is a perspective view illustrating the operating member 304 of an electronic device 100 according to a fifth one of various embodiments of the present disclosure. FIG. 15 is a perspective view illustrating the operating member 304 of the electronic device 100 according to the fifth one of various embodiments of the present disclosure, in which the operating member 104 is viewed from another direction.

Figure 16:
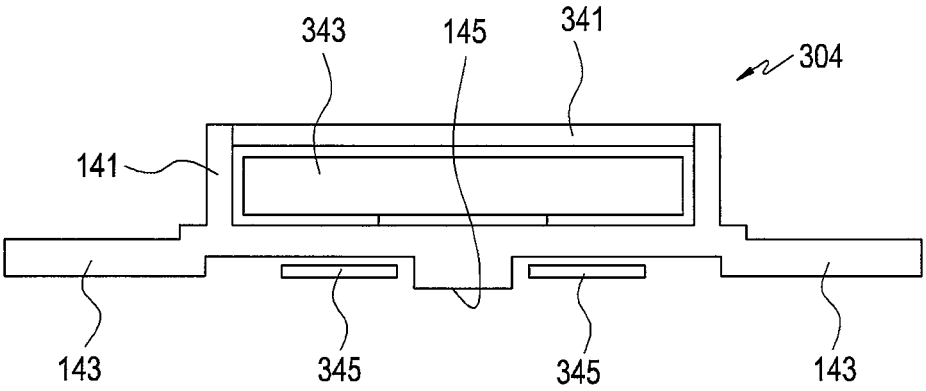
FIG. 16 is a cross-sectional view illustrating a configuration of the operating member of the electronic device according to the fifth one of various embodiments of the present disclosure.

FIG. 16 is a perspective view illustrating the operating member 104 of the electronic device 100 according to the fifth one of various embodiments of the present disclosure.

Referring to FIGS. 14, 15 and 16, the operating member 304 can include a sensor unit 343 therein. The sensor unit 343 can include, for example, a fingerprint recognition sensor, a sensor that senses a biometric signal, such as blood pressure, heart rate, or pulse, or a sensor that analyzes body components from a body fluid, such as sweat. The sensor unit 343 can be accommodated in the body 141 of the operating member 104, and a transmission window 341 can be provided on the front face of the body 141. For example, in the case where the sensor unit 343 is configured as a fingerprint recognition sensor, the user can touch the user's fingerprint on the transmission window 341 such that the fingerprint can be recognized. When the sensor unit 343 is configured as a sensor that senses a biometric signal or a sensor that analyzes body components, the transmission window 341 can be properly replaced depending on the sensor unit 343.

The sensor unit 343 can be connected to a circuit board (e.g., the above-described circuit board 105 or 205) via a flexible printed circuit board 345. The flexible printed circuit board 345 can include a retreating hole, and can extend from the sensor unit 343 to be drawn out to the outside of the body 141. The flexible printed circuit board 345 can be bent in the outside of the body 141 to be at least partially positioned on the bottom face of the body 141. At this time, the actuating protrusion 145 of the operating member 104 can be accommodated in the retreating hole. While FIGS. 15 and 16 illustrate the retreating hole in the state where the actuating protrusion 145 is accommodated in the retreating hole, it is noted that the reference numeral of the retreating hole is not indicated. As the actuating protrusion 145 is accommodated in the retreating hole, the flexible printed circuit board 345 can be symmetrically arranged with respect to the actuating protrusion 145 as the center. As the flexible printed circuit board 345 is symmetrically arranged with reference to the actuating protrusion 145 as the center, the operating member 104 can be disposed to be horizontal to the circuit board (e.g., the above-described circuit board 105 or 205) or the bottom face of the accommodation recess (e.g., the above-described accommodation recess 131, 231, 331, or 431).

According to various embodiments, the stepped portion 147 can be formed such that the width protruding from the outer peripheral surface of the body 141 is constant along the periphery of the body 141. For example, the outer peripheral surface of the stepped portion 147 can be formed to be parallel to the outer peripheral surface of the body 141. According to a certain embodiment, the width of the stepped portion 147 can be formed such that the width of a portion is larger than that of the other portion. Referring to FIGS. 14 and 15, at least the portions 141*a* (hereinafter, referred to as "first curved portions") of the body 141 can be formed in a curved shape that has a first curvature, and the portions 349 (hereinafter, referred to as "second curved portions") of the stepped portion 147, which correspond to the first curved portions 141*a*, can be formed in a curved shape that has a curvature smaller than that of the first curved portions 141*a*. For example, the second curved portions 349 can have a shape that protrudes from the outer peripheral surface of the body 141 more than the other portion of the stepped portion 147.

The second curved portions 349 can contribute to actuating the switch member more correctly when the operating member 104 is operated by the user. For example, the user can operate the operating member 104 at a position that is offset from the actuating protrusion 145. In this event, as the second curved portion 349 is supported on the inner face of the ornamental member 102, the actuating protrusion 145 can be moved downwardly to stably actuate the switch member 151.

As an example, in operating the operating member 104 illustrated in FIG. 14, when the user pushes the body 141 on the right first curved 141*a*, the actuating protrusion 145 can interfere with the switch member 151. However, in this event, when the operating member 104 illustrated in FIG. 14 does not include the second curved portions 349, the left first curved portion 141*a* can be moved in the direction opposite to the user's operating direction. For example, when the body 141 is operated at a position that is offset from the actuating protrusion 145, a pressure, which is sufficient for actuating the switch member, may not be applied while merely generating a seesaw phenomenon. On the contrary, in the case of the electronic device 100 according to various embodiments of the present disclosure, when the user pushes the body 141 on the right first curved portion 141*a*, the right second curved portion 349 among the second curved portions 349 can be supported on the inner face of the ornamental member 102. Accordingly, even if the right first curved portion 141*a* is operated, the seesaw phenomenon can be suppressed, and the actuating protrusion 145, which is positioned between the second curved portions 349, is moved downward to actuate the switch member.

As described above, according to various embodiments of the present disclosure, an electronic device includes a support member, an ornamental member that is assembled to face one face of the support member; and an operating member that is disposed on the support member to be partially exposed to outside through the ornamental member. The operating member includes a body that is positioned on the one face of the support member to be exposed through the ornamental member; and at least one pair of fastening pieces, each of which extends from the body and is fastened to the support member.

According to various embodiments, the electronic device further includes a circuit board that is disposed on the support member, and the circuit board includes a switch member that is actuated by the operating member.

According to various embodiments, the operating member further includes an actuating protrusion that is formed to correspond to the switch member.

According to various embodiments, the circuit board is disposed on the support member to face the ornamental member with the operating member being interposed therebetween.

According to various embodiments, the circuit board further includes a first switch unit on which the switch member is disposed, and second switch units that extend from opposite sides of the first switch unit in directions away from each other.

According to various embodiments, the fastening pieces is located at the opposite sides of the body to be offset to each other, and to be parallel to the second switch units, respectively.

According to various embodiments, the support member includes a through-hole that is formed at a position that corresponds to the operating member, and the circuit board is disposed to face the operating member with the support member interposed therebetween.

According to various embodiments, the switch member is disposed to face the operating member through the through-hole.

According to various embodiments, the support member includes an accommodation recess that is formed on one face of the support member, and fastening recesses that are formed on opposite side walls of the accommodation recess, respectively. The body is accommodated in the accommodation recess in a state where the fastening pieces are engaged with the fastening recesses, respectively, so that the operating member may be mounted on the one face of the support member.

According to various embodiments, the fastening recesses extend from the accommodation recess in directions away from each other, and the body is gradually accommodated in the accommodation recess by causing the body to reciprocate in the accommodation recess in the directions where the fastening recesses extend, and causing the fastening pieces to be engaged with the fastening recesses, respectively.

According to various embodiments, the support member further includes retreating recesses that are formed inside the fastening recesses, respectively, and the fastening pieces partially move into the retreating recesses temporarily while the body reciprocates.

According to various embodiments, each of the fastening recesses extends in a first direction on the support member, and the body is gradually accommodated in the accommodation recess as the body moves in the first direction when the fastening pieces are positioned to correspond to the fastening recesses, respectively.

According to various embodiments, the fastening recesses extends in opposite directions in relation to each other on the support member, and the fastening pieces and the fastening recesses may be fastened to each other as the body is rotated in a state where the body is accommodated in the accommodation recess such that the fastening pieces are positioned to correspond to the fastening recesses, respectively.

According to various embodiments, the operating member further includes: a sensor unit that is accommodated within the body; a flexible printed circuit board that includes a retreating hole, and extends from the sensor unit to be drawn out to the outside of the body; and an actuating protrusion that is formed on a bottom face of the body.

The flexible printed circuit board is bent at the outside of the body to be at least partially positioned on the bottom face of the body, and the actuating protrusion is accommodated in the retreating hole.

According to various embodiments, the above-described electronic device may further include a display element that is interposed between the support member and the ornamental member, and the ornamental member may include a window member that transmits a screen that is output from the display element.

According to various embodiments, the operating member is located at one side of the display element.

According to various embodiments, the operating member further includes a stepped portion that is formed along a periphery of the body.

According to various embodiments, at least a portion (hereinafter, referred to as a "first curved portion") of the body is formed in a curved shape that has a first curvature, and a portion of the stepped portion, which corresponds to the first curved portion, is formed in a curved shape that has a curvature smaller than the first curvature.

While the present disclosure has been shown and described with reference to certain embodiments thereof, it will be understood by those skilled in the art that various changes in form and details may be made therein without departing from the spirit and scope of the present disclosure as defined by the appended claims.

For example, although not described in the specific embodiments of the present disclosure, the switch member may include a mechanically operated switch member, such as a dome switch or a tact switch.

In addition, while the various embodiments of the present disclosure described above have partially different structures, the structures of the respective embodiments may be combined with each other or may be replaced with each other within the limits that do not exceed the scope of the present disclosure. For example, while the structure of the stepped portion that includes the second curved portion or the structure of the operating member that includes a sensor unit has been described with reference to the embodiment illustrated in FIG. 14, such structures may be combined with the preceding embodiments.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An electronic device comprising:
- a support member;
- an ornamental member assembled to face one face of the support member; and
- an operating member that is disposed on the support member to be partially exposed to outside through the ornamental member,
- wherein the operating member includes:
  - a body that is positioned on one face of the support member to be exposed through the ornamental member; and
  - at least one pair of fastening pieces, each of fastening pieces extending from the body to be fastened to the support member, and
  - wherein the support member includes:
    - an accommodation recess formed on the one face of the support member; and
    - fastening recesses formed on opposite side walls of the accommodation recess, respectively, and
    - wherein the body is accommodated in the accommodation recess when the fastening pieces are engaged with the fastening recesses, respectively, so that the operating member is mounted on the one face of the support member.

2. The electronic device of claim 1, further comprising:
- a circuit board disposed on the support member,
- wherein the circuit board includes a switch member that is actuated by the operating member.

3. The electronic device of claim 2, wherein the operating member further comprises an actuating protrusion that is formed to correspond to the switch member.

4. The electronic device of claim 2, wherein the circuit board is disposed on the support member to face the ornamental member with the operating member interposed therebetween.

5. The electronic device of claim 4, wherein the circuit board further includes:
- a first switch unit on which the switch member is disposed; and
- second switch units that extend from opposite sides of the first switch unit in directions away from each other.

6. The electronic device of claim 5, wherein the fastening pieces are disposed at opposite sides of the body to be offset to each other, and to be parallel to the second switch units, respectively.

7. The electronic device of claim 2, wherein the support member includes a through-hole that is formed at a position that corresponds to the operating member, and the circuit board is disposed to face the operating member with the support member being interposed therebetween.

8. The electronic device of claim 7, wherein the switch member is disposed to face the operating member through the through-hole.

9. The electronic device of claim 1, wherein the fastening recesses extend from the accommodation recess in directions away from each other, and the body is gradually accommodated in the accommodation recess by causing the body to reciprocate on the accommodation recess in a direction where the fastening recesses extend, and causing the fastening pieces to be engaged with the fastening recesses, respectively.

10. The electronic device of claim 9, wherein the support member further includes retreating recesses that are formed inside the fastening recesses, respectively, and the fastening pieces partially move into the retreating recesses temporarily while the body reciprocates.

11. The electronic device of claim 1, wherein each of the fastening recesses extends in a first direction on the support member, and the body is gradually accommodated in the accommodation recess as the body moves in the first direction when the fastening pieces are positioned to correspond to the fastening recesses, respectively.

12. The electronic device of claim 1, wherein the fastening recesses extend in opposite directions in relation to each other on the support member, and the fastening pieces and the fastening recesses are fastened to each other as the body is rotated in a state where the body is accommodated in the accommodation recess such that the fastening pieces are positioned to correspond to the fastening recesses, respectively.

13. The electronic device of claim 1, wherein the operating member includes:

a sensor unit accommodated within the body;

a flexible printed circuit board that includes a retreating hole, and extends from the sensor unit to be drawn out to the outside of the body; and an actuating protrusion formed on a bottom face of the body, wherein the flexible printed circuit board is bent at the outside of the body to be at least partially positioned on the bottom face, and the actuating protrusion is accommodated in the retreating hole.

14. The electronic device of claim 1, further comprising:

a display element interposed between the support member and the ornamental member, wherein the ornamental member includes a window member transmitting a screen that is output from the display element.

15. The electronic device of claim 14, wherein the operating member is disposed on one side of the display element.

16. The electronic device of claim 1, wherein the operating member further includes a stepped portion that is formed along a periphery of the body.

17. The electronic device of claim 16, wherein at least one first curved portion of the body is formed in a curved shape that has a first curvature, and a portion of the stepped portion, that corresponds to the at least one first curved portion, is formed in a curved shape that has a curvature smaller than the first curvature.

* * * * *